United States Patent [19]

Scales

[11] 3,949,438

[45] Apr. 13, 1976

[54] INFLATABLE SUPPORT APPLIANCE

[76] Inventor: John Tracey Scales, 17, Brockley Ave., Stanmore, Middlesex, HA7 4LX, England

[22] Filed: Nov. 18, 1974

[21] Appl. No.: 524,871

[30] Foreign Application Priority Data

Nov. 20, 1973 United Kingdom ..... 53797/73

[52] U.S. Cl. ..... 5/348 R; 5/347; 5/91

[51] Int. Cl.[2] ..... A47C 27/08; A47C 29/00

[58] Field of Search ..... 5/348 R, 349, 350, 345, 5/355, 361, 361 B, 347, 91

[56] References Cited

UNITED STATES PATENTS

| | | | |
|---|---|---|---|
| 1,142,876 | 6/1915 | Davis et al. | 5/347 X |
| 2,543,218 | 2/1951 | Young et al. | 5/345 R |
| 2,750,606 | 7/1956 | Freedlander et al. | 5/347 X |
| 3,266,064 | 8/1966 | Figman | 5/347 |
| 3,521,311 | 7/1970 | Cohen | 5/361 B |
| 3,822,425 | 7/1974 | Scales | 5/348 R |

*Primary Examiner*—Paul R. Gilliam
*Assistant Examiner*—Andrew M. Calvert
*Attorney, Agent, or Firm*—Cushman, Darby & Cushman

[57] ABSTRACT

The disclosure relates to a support appliance in the form of a mattress formed from a resilient foam material having interconnecting air transmitting cells, the upper surface of the mattress having at least an impedance to gas flow whilst permitting transmission of water vapour from the outer to the inner side thereof for removal by air flow through the mattress effected by an air pump.

17 Claims, 1 Drawing Figure

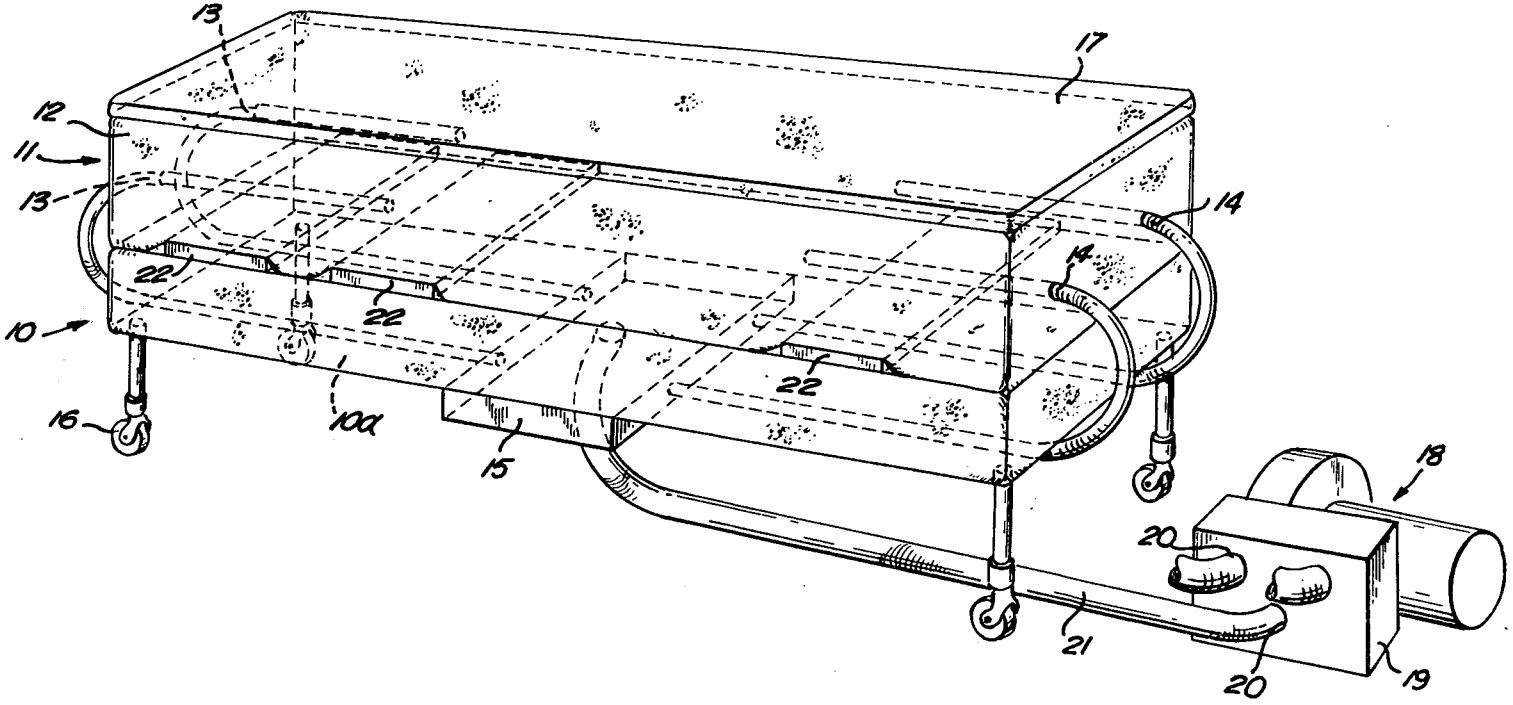
10
11
12
13
13
14
14
15
16
17
18
19
20
20
21
22
22
22
100

INFLATABLE SUPPORT APPLIANCE

BACKGROUND OF THE INVENTION

1. Field of the Invention

This invention relates to support appliances in particular air cushions, air mattresses, pillows and the like.

2. Description of the Prior Art

My U.S. Pat. No. 3,822,425 discloses an air support appliance, for example an air mattress which comprises an envelope of material which is inflated by air under pressure flowing continuously through the mattress. The surface material of at least the upper surface of the mattress is a material which is substantially impermeable to liquids and solids but is capable of transmitting water vapour when the water vapour partial pressure is higher on one side of the material than the other so that water vapour generated by the user of the bed passes through the upper surface of the mattress and is carried away with the continuous stream of air flowing through the mattress. A disadvantage with the air mattress described above is that air pressure is required not only to purge the mattress but also to support the user of the bed and this requires a substantial air pump. It is an object therefore of this invention to provide a construction of support appliance on which there is less dependance or air pressure for supporting the user of the appliance.

SUMMARY OF THE INVENTION

The invention provides support appliances comprising a body of resilient foamed material having continuous interconnecting air transmitting cells and which body has sufficient dimensions and density to provide support for a user, a portion of the surface area of the body, on which a user is intended to be supported, providing at least an impedance to gas flow but being capable of transmitting water vapour on the outside of said portion of the surface area to within the body of foam, and the remainder of the surface area of the body of foam being rendered substantially gas-tight, means being provided to supply gas under pressure to within the body of foam to inflate the body.

BRIEF DESCRIPTION OF THE DRAWING

The drawing is a perspective view of a hospital bed in accordance with the invention.

DESCRIPTION OF THE PREFERRED EMBODIMENTS

The bed shown in the drawing comprises a base 10 and an air mattress 11 mounted on the base. The base 10 comprises a rectangular wooden frame having the dimensions of an average single bed and comprising a baseboard and four upstanding side walls defining a trough-shaped cavity. The cavity is filled with a layer of resilient foamed material 10*a*. The mattress 11 comprises a body of resilient foamed material 12 which has the same external dimensions as the base 10 but is twelve inches deep. The body of foam 12 comprises a polyether foam having continuously interconnected air transmitting cells and having its upper surface heat treated such that it provides an impedance to gas flow therethrough so that the body can be inflated by air supplied to the foam as described later without the use of a particularly large air pump. The foam is selected to provide a generally even support to the user of the mattress at pressures which will not interfere with the blood supply to and from the tissues to avoid the forming of pressure sores or skin ulcers. The upper surface permits the passage therethrough of water vapour and the flow of air through the foam from the pump removes the water vapour transmitted into the foam from the patient and, similarly, also any carbon dioxide. The water vapour partial pressure in the foam is thus maintained relatively low by the through put of air to encourage water vapour emitted by the patient to be absorbed into the foam and removed by the air flow. An example of such a foam is made by Lyo-Research Limited of Sittingbourne, Kent, under the trade name Lyofoam. Suitable examples of such foam material are given in U.S. Pat. No. 3,822,425 which also describes a suitable surface heat treatment as aforesaid.

The body of foam is covered on its side faces and lower face by a material which is impermeable to gases or liquids but is capable of transmitting water vapour when the water vapour partial pressure on one side of the layer exceeds that on the other side of the layer. The gas-tight material comprises a layer of 1.5 oz. 30 denier nylon having a backing layer 0.5mm. thick of polyurethane ester foam, 0.26 density which is covered on its side remote from the nylon layer with a polyurethane film.

Four pipes 13,14 provided by flexible tubing are embedded in the foam and project outwardly therefrom and extend beneath the base to an air inlet manifold 15 to which they are connected. The manifold 15 comprises a rectangular box secured to the other side of the base and having a pair of apertures in each of its end faces to receive the flexible tubes and an inlet in its lower face. Castors 16 are provided at the corners of the base to provide a clearance for the manifold and tubes.

The length of each tube embedded within the foam is selected to provide a discharge of air at areas of the mattress that are likely in use to be most heavily loaded. In the example shown in the drawing the tubes 13,14 which enter from the same end of the body of foam extend by different amounts into the body of foam so that their discharges are provided at the aforesaid heavily loaded regions. Furthermore the diameter of the tubing 13 at the end of the mattress which will support a user's head is larger than that of the tubing 14 at the opposite end of the mattress since that end of the mattress is likely to be more heavily loaded than the opposite end. The tubes 13 are 3 inches in diameter and the tubes 14 are 2 inches in diameter.

The upper surface of the body of foam which in use receives a patient, is covered by a further relatively thin layer 17 of foam which is releasably secured to the main body of foam by providing along the edges on the opposed faces of the body of foam and the layer of foam strips of a material which provide an attachment connection, when pressed together, for example the strips may be made of Velcro (Registered Trade Mark). The foamed material of the layer 17 must be non-toxic and also the layer must impede the flow of air therethrough. The layer 17 can also be made of Lyofoam as used for the body 11 and also may have a heat treated upper surface. The layer 17 must also allow for the passage therethrough of gases released by a body resting on a mattress so that such gases can be carried away in the airstream provided by the pressurised air supplied to the body of the foam which escapes through the layer at regions not covered by the patient resting on the bed or through the side walls of the layer. These gases may include water vapour resulting from perspiration or insensible loss and carbon dioxide which forms at wounds. However in use the foam layer 17 will eventually become soiled by the ingress of solids and liquids which penetrate into the layer at which stage the layer is removed from the body of foam and a further fresh layer is located in its place. In this way the air-bed is provided with a disposable and replaceable support surface layer which is changed from time to time.

Alternatively to prevent the ingress of solids and liquids whilst permitting the transmission of water vapour and carbon dioxide, the surface of the layer 17 may be coated with a polyurethane, silicone or vinyl copolymer resin as described in U.S. Pat. No. 3,822,425 to provide a continuous layer which is non-porous to solids and liquids but is capable of transmitting water vapour when the partial water vapour pressure on one side of the layer exceeds that on the other side.

Specific examples of the suitable resins and their method of application are to be found described in U.S. Pat. No. 3,822,425.

In a further embodiment of the invention the layer of foam 17 is omitted and the upper surface of the body 11 of foam is covered with a flexible and extensible continuous film material that allows transmission of gas therethrough but does not retain nor transmit solids or liquids. The film may again comprise a gas-permeable polyurethane, silicone or vinyl copolymer resin allowing the passage of water vapour at least about 230 g./sq.m./ 24 hrs. at 37°C. as described in my U.S. Pat. No. 3,822,425. The film permits the passage of water vapour which enters the molecular structure of the film to gradually pass through it. However since the film is not porous liquids and solids remain on the surface of the film. The said film is permanently secured to the top of the body of foam. An outlet for discharging the air within the body 11 of foam is provided in this embodiment since air leakage through the film is not sufficient. In this embodiment the covered upper surface of the body of foam will not receive and harbour solids and liquids so that it can be maintained cleaned and sterilised.

In a further embodiment of the invention the body 11 of foam is not heat treated on its upper surface but is covered by a flexible and extensible continuous film material as described in the previous paragraph. The film impedes the air flow through the upper surface of the body 11. A disposable layer 17 is then provided over the film covered upper surface of the body of foam 11.

The temperature of the air supplied to the bed is regulated by a heated control provided in the manifold 15 to influence the temperature of the user of the bed. The air is supplied by a motor-driven fan unit 18 to a distributor box 19 incorporating an air filter and having a pluraility of outlets 20., the one in the drawing having three outlets. Each outlet 20 is connected by a flexible trunking 21 (only one trunking is illustrated) to the inlet to the manifold 15 mounted on the underside of an air-bed, as described above.

Individual blocks of foam 22 having a greater density than that of the body 11 of foam are located between the body 11 of foam and the base 10 at different locations along the mattress in order to provide extra support at those locations as required. Furthermore, stiffer blocks of higher density foam may be provided along the sides of the body of foam 11. Also foam backed end plates may be bonded to the ends of the foam body 11.

Instead of such blocks it would be possible so to foam the body of foam 11 to have regions of differing density so that more support is provided at particular locations.

In yet a further construction, the foam body 11 may comprise a number, for example five, individual foam blocks which are isolated from each other. The blocks may have differing densities and may have individual valve controlled air supplies from a common pump so that the degree of support provided for the patient at different positions along the bed can be varied.

The bed may further be provided with raised side walls and head and tail boards to prevent the patient falling off and may also have a foot drop board to permit the foot of the bed to be inclined downwardly from the main body of the bed. Supports may be provided for conventional traction apparatus. The mattress 11 may also be mounted on a standard "King Edward Fund" type bed or any other standard hospital bed.

I claim:

1. A support appliance comprising a body of resilient foamed material having continuous interconnected air transmitting cells and which body has sufficient dimensions and density to provide support for a user, a portion of the surface area of the body, on which a user is intended to be supported, providing an impedance to gas flow but being capable of transmitting water vapour on the outside of said portion of the surface area to within the body of foam, and the remainder of the surface area of the body of foam being rendered substantially gas-tight, and means for providing a flow of gas under pressure through the body of foam to inflate the body and to remove water vapour transmitted through said portion of the surface area of the body.

2. An appliance as claimed in claim 1 wherein the body of foam is a polyether foam.

3. An appliance as claimed in claim 1 wherein, said portion of the surface area of the body of foam is covered with a flexible and extensible layer of material the surface of which remote from the body of foam provides an impedance to gas flow through the layer but is capable of transmitting water vapour through the layer, said layer being releasably secured to said portion such that it continuously conforms to the shape of said portion.

4. An appliance as claimed in claim 3 wherein the said releasable layer is made of a resilient foamed material which is non-toxic.

5. An appliance as claimed in claim 4 wherein the layer is made of a polyether foam.

6. An appliance as claimed in claim 1 wherein, said portion of the surface area of the body of foam is covered with a layer of flexible and extensible continuous material which is non-permeable to solids and liquids but is capable of transmitting water vapour through the layer, said layer being secured to said portion, and an outlet being provided for discharging gas from the body of foam.

7. An appliance as claimed in claim 6 wherein said layer is a plastics coating of polyurethane, silicone or vinyl copolymer resin.

8. An appliance as claimed in claim 7 wherein the coating is capable of allowing the passage of water vapour at at least 230g./sq.m./24 hours at 37°C.

9. An appliance as claimed in claim 1 wherein said remainder of the surface of the body of foam may be covered by a gas-tight material.

10. An appliance as claimed in claim 9 wherein the gas-tight material comprises a fabric layer having a foam backing, which is covered on its side remote from the fabric with a polyurethane film.

11. An appliance as claimed in claim 1 wherein said means to supply gas under pressure comprises at least one pipe which is embedded in the foam and projects outwardly therefrom.

12. An appliance as claimed in claim 11 wherein several of said pipes are embedded in the foam to supply pressurised gas to different parts of the appliance.

13. An appliance as claimed in claim 12 wherein the pipes are connected to a manifold having an inlet for receiving pressurised gas.

14. An appliance as claimed in claim 13 wherein the manifold is provided with means for controlling the temperature of the gas.

15. An appliance as claimed in claim 1 wherein the body of foam is elongate to provide a mattress which can be mounted on a base portion.

16. An appliance as claimed in claim 15 wherein one or more blocks of a material having a greater density than that of the body of foam are located between the base and the mattress to provide additional support at different locations along the mattress.

17. An appliance as claimed in claim 15 wherein the body of foam has portions of greater density than the remainder of the body to provide greater support at those areas for the patient lying on the foam body.

* * * * *